United States Patent [19]

Anthony

[11] 3,942,852

[45] Mar. 9, 1976

[54] CABINET DRAWER

[75] Inventor: Roy Anthony, Briarcliff Manor, N.Y.

[73] Assignee: Uniroyal, Inc., New York, N.Y.

[22] Filed: Dec. 4, 1974

[21] Appl. No.: 529,326

[52] U.S. Cl. ..... 312/294; 312/234.3

[51] Int. Cl.[2] ..... A47F 3/00; A47B 81/00

[58] Field of Search ..... 312/294, 138 A, 234.1, 312/234.3, 126, 127

[56] References Cited

UNITED STATES PATENTS

| | | | |
|---|---|---|---|
| 300,724 | 6/1884 | Nauerth | 312/294 |
| 404,458 | 6/1889 | Woodruff | 312/234.1 |
| 855,767 | 6/1907 | Gibson | 312/234.3 |
| 1,106,543 | 8/1914 | Burnham et al. | 312/126 |
| 2,335,391 | 11/1943 | Cushing | 312/234.3 |
| 2,505,898 | 5/1950 | Jaffe et al. | 312/138 A |
| 2,541,352 | 2/1951 | Ginter | 312/294 |
| 2,826,471 | 3/1958 | Fonda | 312/138 A |
| 3,120,984 | 2/1964 | Stohlberg | 312/234.3 |
| 3,346,313 | 10/1967 | Fee | 312/234.1 |
| 3,554,625 | 1/1971 | Sly, Sr. | 312/126 |

FOREIGN PATENTS OR APPLICATIONS

| | | | |
|---|---|---|---|
| 812,594 | 7/1951 | Germany | 312/234.3 |
| 1,345,004 | 10/1963 | France | 312/234.1 |

*Primary Examiner*—Paul R. Gilliam
*Assistant Examiner*—Victor H. Sakran
*Attorney, Agent, or Firm*—Charles A. Blank

[57] ABSTRACT

A cabinet drawer for displaying and storing shoes in which a pair of shoes are displayed on the front of the drawer and similar shoes of various sizes are stored in compartments of the drawer with indicia showing the shoe sizes readily apparent.

4 Claims, 2 Drawing Figures

CABINET DRAWER

Figure 2:
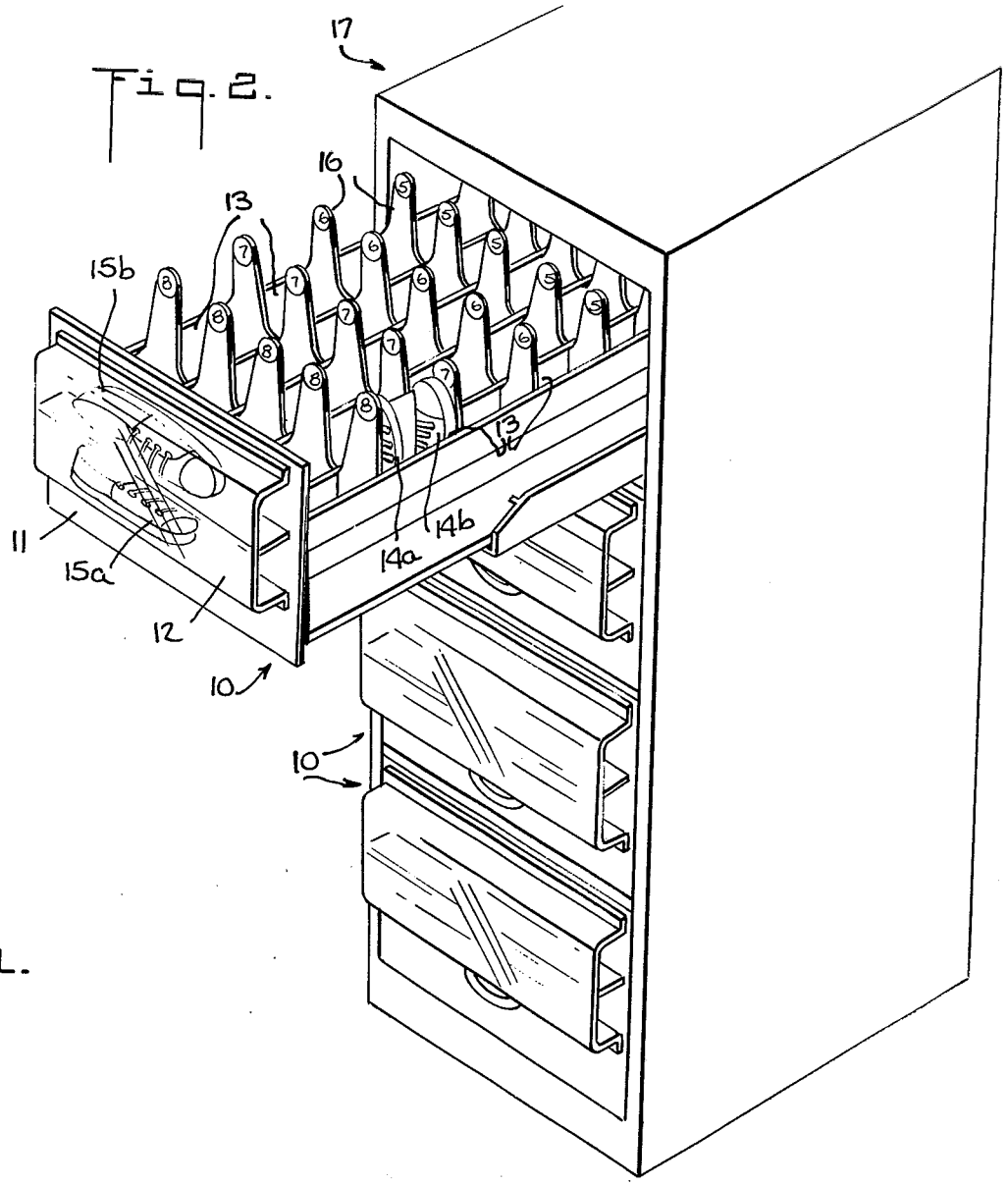

This invention relates to a cabinet drawer for displaying and storing shoes and to a cabinet having a plurality of such drawers therein.

Heretofore it has been common to display shoes on a rack and to store shoes in boxes on open racks.

It is an object of the present invention to provide a new and improved cabinet drawer for displaying and storing shoes.

It is another object of the invention to provide a new and improved cabinet drawer in which a pair of shoes may be displayed on the front thereof and similar shoes of various sizes may be stored in the cabinet drawer in separate compartments thereof.

It is another object of the invention to provide a new and improved cabinet drawer in which individual pairs of shoes are stored in compartments with the sizes of the shoes visible from the front of the drawer.

In accordance with the invention, a cabinet drawer comprises a front panel having attached in front thereof a transparent compartment for holding at least one shoe for display. The drawer also includes a plurality of interior compartments in the drawer, each compartment being capable of holding a pair of shoes. The interior compartments include vertical portions for bearing indicia relating to the shoes in the compartments.

For a better understanding of the present invention, together with other and further objects thereof, reference is made to the following description, taken in connection with the accompanying drawings and its scope will be pointed out in the appended claims.

Figure 1:
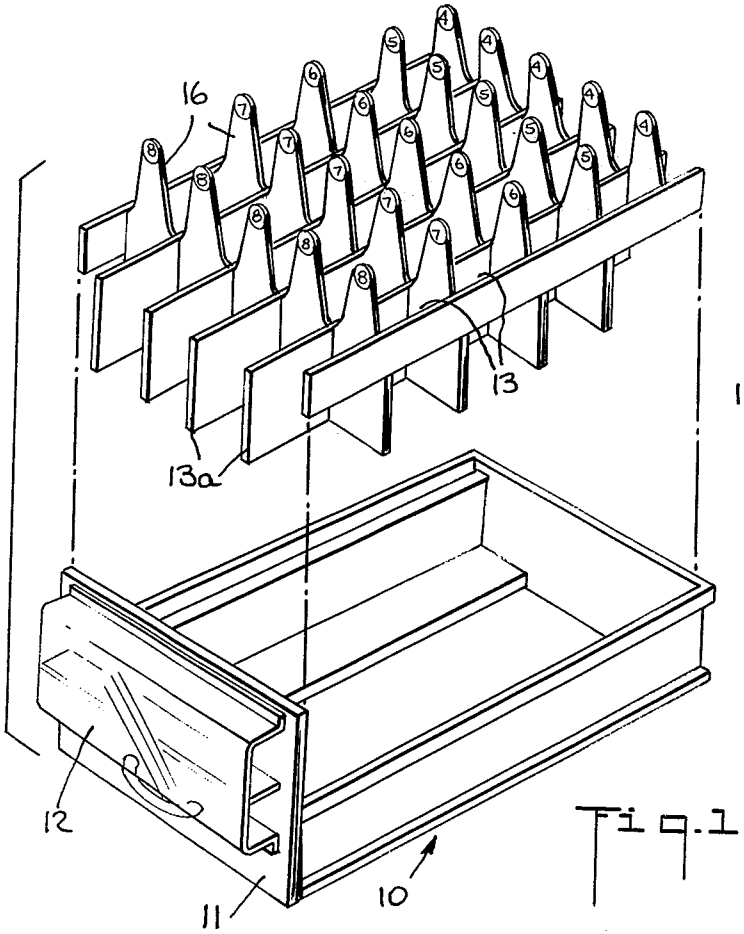

Referring now to the drawings:

FIG. 1 is an exploded perspective view of a cabinet drawer constructed in accordance with the invention; and FIG. 2 is a perspective view of a cabinet constructed in accordance with the invention containing a plurality of drawers such as the FIG. 1 drawer.

Referring now more particularly to FIG. 1 of the drawings, a cabinet drawer 10 comprises a front panel 11 having attached in front thereof a transparent compartment 12 for holding at least one shoe for display. The cabinet drawer may, for example, be of suitable metal construction and the transparent compartment may, for example, be of a suitable transparent plastic material, such as Lucite, a trademark of E. I. du Pont de Nemours & Co.

The drawer has a plurality of interior compartments 13 with each compartment preferably being capable of holding a pair of shoes 14*a*, 14*b*, as represented in FIG. 2. As also represented in the FIG. 2 cabinet 17, the transparent compartment 12 may hold a pair of shoes 15*a*, 15*b* for display.

As represented in FIGS. 1 and 2, the interior compartments 13 include vertical portions 16 for bearing indicia relating to the shoes in the compartments. As represented in FIG. 2, these vertical indicia bearing portions of the interior compartments are visible from the front of the drawer and preferably their indicia indicate the sizes of the shoes in the corresponding compartments.

As also represented in FIG. 2, the cabinet 17 has a plurality of such cabinet drawers in a vertical column. Accordingly, shoes of different styles may be displayed on the front panel of such drawer and the drawers may contain shoes corresponding to that style in various sizes.

The partitions 13*a* of the interior compartments may be made out of any suitable material, for example, a plastic material such as Lucite or a pressed fiber board, which may be covered with a non-abrasive coating.

It is contemplated that the cabinets for men's shoes preferably are three drawers high, the cabinets for women's shoes preferably are four drawers high and the cabinets for children's shoes preferably are five drawers high with all cabinets having the same total overall height. The cabinets may be opened and closed in a conventional manner.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

I claim:

1. A cabinet drawer comprising:

an opaque front panel covering the contents of the drawer and having attached in front thereof a transparent compartment, having a transparent front wall, for holding at least one shoe for display; and a plurality of interior compartments in said drawer, each interior compartment being capable of holding a pair of shoes;

said interior compartments including vertical portions for bearing indicia relating to the shoes in said interior compartments.

2. A cabinet drawer in accordance with claim 1 which has a transparent compartment attached in front thereof for holding a pair of shoes for display.

3. A cabinet drawer in accordance with claim 1 in which said vertical portions for bearing indicia relating to the shoes in said interior compartments are visible over said front panel from the front of the drawer.

4. A cabinet having a plurality of cabinet drawers in a vertical column in which each of said cabinet drawers comprises:

an opaque front panel covering the contents of the drawer and having attached in front thereof a transparent compartment, having a transparent front wall, for holding at least one shoe for display; and a plurality of interior compartments in each drawer, each interior compartment being capable of holding a pair of shoes;

said interior compartments including vertical portions for bearing indicia relating to the shoes in said interior compartments.

* * * * *